United States Patent [19]

Heki et al.

[11] Patent Number: 4,469,784

[45] Date of Patent: Sep. 4, 1984

[54] SILVER HALIDE EMULSIONS

[75] Inventors: Tatsuo Heki; Hiroyuki Mifune, both of Kanagawa, Japan

[73] Assignee: Fuji Photo Film Co., Ltd., Kanagawa, Japan

[21] Appl. No.: 423,331

[22] Filed: Sep. 24, 1982

[30] Foreign Application Priority Data

Sep. 28, 1981 [JP] Japan ..... 56-153293

[51] Int. Cl.[3] ..... G03C 1/02

[52] U.S. Cl. ..... 430/567; 430/569

[58] Field of Search ..... 430/600, 606, 613, 614, 430/564, 569, 567

[56] References Cited

U.S. PATENT DOCUMENTS

| | | | |
|---|---|---|---|
| 1,696,830 | 12/1928 | Wulff | 430/614 |
| 3,137,578 | 6/1964 | DeSelms | 430/614 |
| 3,271,154 | 9/1966 | Dersch et al. | 430/614 |
| 3,808,005 | 4/1974 | Willems et al. | 430/613 |
| 3,813,250 | 5/1974 | Takamura et al. | 430/614 |
| 3,817,756 | 6/1974 | Claes et al. | 430/569 |
| 4,001,021 | 1/1977 | Nakajima et al. | 430/567 |
| 4,131,467 | 12/1978 | Bigelow | 430/614 |

*Primary Examiner*—Mary F. Downey

*Attorney, Agent, or Firm*—Sughrue, Mion, Zinn, Macpeak, and Seas

[57] ABSTRACT

A silver halide emulsion is disclosed which contains silver halide grains formed in the presence of a silver halide solvent. The solvent is a benzimidazole derivative having a hydrogen atom connected to the nitrogen atom at the 1st position thereof. By using this particular solvent a regular silver halide photographic emulsion having high sensitivity causing less fog is obtained. The silver halide solvent is unexpectedly advantageous in that can be almost completely desorbed from the silver halide grains by washing.

13 Claims, No Drawings

SILVER HALIDE EMULSIONS

FIELD OF THE INVENTION

This invention relates to silver halide photographic emulsions prepared by using silver halide solvents, and more particularly, to silver halide emulsions prepared by using silver halide solvents which tend to form regular silver halide grains (group) regardless of the pAg range the silver halide grains are prepared.

BACKGROUND OF THE INVENTION

The photographic sensitivity of a silver halide emulsion increases with the increase of the size of the silver halide grains. There is a known method of obtaining silver halide grains having increased grain size by forming the silver halide grains in the presence of a reagent called a silver halide solvent. Ammonia is perhaps the oldest known silver halide solvent. However, ammonia is only capable of increasing the grain size of silver halide within a high pH range. Therefore, the use of ammonia inevitably causes an increase in the amount of fog. Furthermore, ammonia does not have a tendency to form regular silver halide grains (i.e., the silver halide grains containing no twin grains, consisting of silver halide grains having cubic, octahedral, or tetradecahedral crystal form, and having a narrow grain size distribution) at a low pBr range (high pAg). Accordingly, the use of ammonia is not convenient because in order to obtain regular silver halide grains (group), the pAg must be strictly controlled in the low range.

Various silver halide solvents other than ammonia have recently been proposed. For example, organic thioethers are described in Japanese Patent Publication No. 11386/72. However, since the compounds are liable to fog silver halide photographic emulsions and require relatively large number of purification for preparing the compounds, the industrial use of such compounds is not practical.

Japanese Patent Application (OPI) Nos. 144319/78 (which corresponds to British Pat. No. 1,586,412) and 82408/78 (the form "OPI" as used herein refers to a "published unexamined Japanese patent application") disclose organic thione compounds such as 3,4-dimethyl-1,3-thiazolidine-2-thione and N,N,N',N'-tetramethylthiourea as silver halide solvents. However, these compounds do not desorb from silver halide grains during the washing step after forming the silver halide grains because the adsorptive power onto the silver halide grains is too strong. Accordingly, these compounds are not desirable because they suppress chemical sensitization which is latter applied to the silver halide emulsion and they obstruct the adsorption of sensitizing dyes onto the silver halide grains.

Japanese Patent Application (OPI) No. 100717/79 (which corresponds to U.S. Pat. No. 4,298,638) discloses a method of forming silver halide grains in the presence of imidazoles but the imidazole compounds disclosed therein do not tend to form regular silver halide grains (group) at a low pBr range (high pAg) as ammonia and twin silver halide grains (plate crystal) having a broad grain size distribution are formed at the low pBr range (see, Example 2).

As described above, conventional silver halide solvents do not have satisfactory properties.

SUMMARY OF THE INVENTION

Accordingly, a primary object of this invention is to provide a silver halide emulsion having a high photographic sensitivity prepared by using a silver halide solvent which does not cause the formation of fog.

Another object of this invention is to provide a regular silver halide emulsion prepared by using a silver halide solvent which tends to form regular silver halide grains (group) even at a low pBr range (high pAg).

Yet another object of this invention is to provide a silver halide emulsion having a high photographic sensitivity prepared by using a silver halide solvent which does not obstruct the application of chemical ripening and the adsorption of sensitizing dyes.

Still another object of this invention is to provide a direct positive silver halide emulsion having a high photographic sensitivity.

Another object of this invention is to provide an internal latent image type direct positive silver halide emulsion composed of core/shell grains having improved discrimination.

Another object of this invention is to provide a process of preparing the foregoing silver halide emulsion.

The aforesaid objects of this invention can be attained by performing the grain formation of silver halide in the presence of a benzimidazole derivative having a hydrogen atom connected to the nitrogen atom located at the first position and also by the silver halide emulsion containing the silver halide grains formed by performing the grain formation as described above.

Thus, the invention provides a silver halide emulsion containing silver halide grains formed by performing the grain formation in the presence of a benzimidazole derivative having a hydrogen atom connected to the nitrogen atom located at the first position thereof.

DETAILED DESCRIPTION OF THE INVENTION

The silver halide solvent of this invention is a compound having a benzimidazole skeleton having a hydrogen atom connected to the nitrogen atom located at the first position thereof. Compounds having such a structure are capable of attaining the objects of this invention although the effect may differ to some extent depending on the particular compound. However, benzimidazole derivatives shown by the following general formula (I) are good silver halide solvents and can be preferably used in this invention:

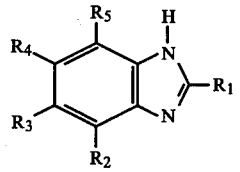

(I)

In general formula (I), $R_1$ represents a hydrogen atom, a halogen atom (e.g., Cl, Br, I, etc.), an alkyl group, an alkenyl group, an aryl group, or a heterocyclic residue.

The alkyl group shown by $R_1$ may have a substituent and alkyl groups having 1 to 8 carbon atoms (particularly 1 to 4 carbon atoms) are preferred. Examples of the substituents for the alkyl groups include a hydroxy group, a cyano group, an alkoxy group, an unsubstituted, mono-substituted, or di-substituted amino group, a morpholino group, a free or esterified carboxyl group, a free or esterified sulfo group, and an aryl group. Practical examples of the alkyl group include a methyl group, an ethyl group, a propyl group, a hydroxymethyl group, a hydroxypropyl group, a diethylaminomethyl group, a morpholinomethyl group, a benzyl group, a phenethyl group, and a carboxymethyl group.

The alkenyl group shown by $R_1$ in general formula (I) may also have a substituent and alkenyl groups having 3 to 8 (particularly 3 to 4 carbon atoms) carbon atoms are preferred. Examples of the substituents include those groups described in connection with the alkyl groups. Practical examples of the alkenyl groups include an allyl group, a butenyl group and an octenyl group.

The aryl group shown by $R_1$ may also have a substituent and aryl groups having 6 to 12 carbon atoms are preferred. Examples of the substituents for the aryl groups include alkyl groups having 1 to 4 carbon atoms in addition to the substituent groups described in connection with the alkyl groups. Practical examples of the aryl groups include a phenyl group and a tolyl group.

The heterocyclic residue shown by $R_1$ is preferably a 5- or 6-membered ring containing a nitrogen atom or an oxygen atom as a constituent for the ring, for example, a pyridyl group, a pyrimidyl group, or a furyl group. In particular, a 2-pyridyl group is preferred.

With respect to $R_1$, a hydrogen atom and a lower alkyl group having 1 to 4 carbon atoms (particularly, a methyl group and an ethyl group) are particularly preferred.

In general formula (I), $R_2$ to $R_5$ may be the same or different and each represents a hydrogen atom, a halogen atom (e.g., Cl, Br, I, etc.), a hydroxy group, an amino group, a nitro group, a cyano group, a carboxy group or a salt thereof (in particular, an alkali metal salt), a sulfo group or a salt thereof (in particular, an alkali metal salt), an alkyl group, an alkenyl group, an aryl group, or an $R_6$—D— group (wherein $R_6$ represents a hydrogen atom, an alkyl group, or an aryl group and D represents —$SO_2$—, —COO—, —OCO—, —CONH—, —NHCO—, —$SO_2$NH—, or —NH-$SO_2$—).

With respect to the foregoing groups, the alkyl groups, alkenyl groups, and aryl groups of $R_2$ to $R_5$ are selected from the same categories of the alkyl group, alkenyl group, and aryl group described in connection with $R_1$ of general formula (I).

With respect to the $R_6$—D— group, the $R_6$ is preferably a hydrogen atom, a lower alkyl group having 1 to 4 carbon atoms or an aryl group having 6 to 12 carbon atoms and further a phenyl group is particularly preferred. Practical examples of the $R_6$—D— group include a methylsulfonyl group, a phenylsulfonyl group, an acetoxy group, a methoxycarbonyl group, an acetylamino group, a benzoylamino group, a carbamoyl group, a methylsulfonylamino group and a sulfamoyl group.

With respect to $R_2$ to $R_5$ groups, a hydrogen atom, a halogen atom, a nitro group, a cyano group, a carboxy group or a salt thereof, a sulfo group or a salt thereof, an alkyl group, and a carboxyalkyl group (i.e., $R_6$ is an alkyl group and D is —COO—) are preferred; a hydrogen atom and a nitro group are more preferred; and a hydrogen atom is particularly preferred.

In this invention, it is particularly preferable to use a compound of general formula (I) wherein $R_1$ is a hydrogen atom or a lower alkyl group having 1 to 4 carbon atoms (particularly a methyl group or an ethyl group) and $R_2$ to $R_5$ are hydrogen atoms.

Practical examples of the silver halide solvent of this invention are illustrated below. Among them, Compounds (1), (2) and (3) are particularly preferred.

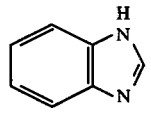
(1)

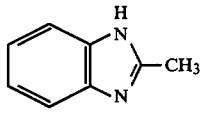
(2)

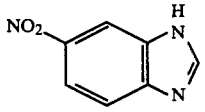
(3)

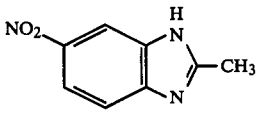
(4)

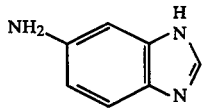
(5)

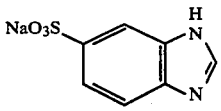
(6)

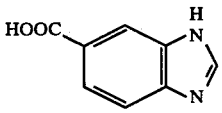
(7)

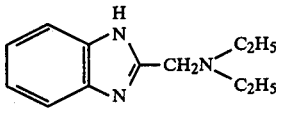
(8)

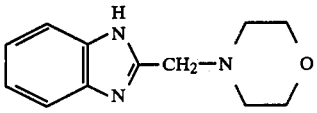
(9)

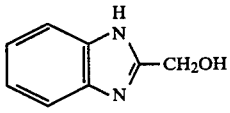
(10)

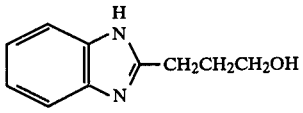
(11)

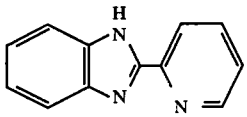
(12)

-continued

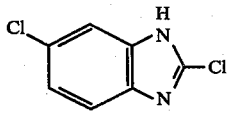
(13)

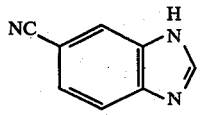
(14)

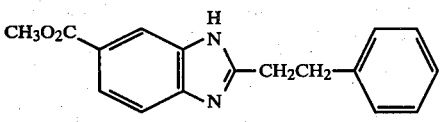
(15)

These compounds used as the silver halide solvents in this invention can be produced according to the general methods described in, for example, Klaus Hofmann, "Imidazole and Its Derivatives", Part I (1953), page 258 (*The Chemistry of Heterocyclic Compounds*) or *D a i Yuki Kagaku* 15, *Fukuso Kanshiki Kagobutsu* II (*Great Organic Chemistry* 15, *Heterocyclic Compounds* II) (edited by Munio Kotake, written by Masaki Oota, 1958), page 238.

Silver halide grains used in the present invention are formed in the presence of the foregoing silver halide solvent. In this specification the term "grain formation" means the stage until the silver halide grains reach their final grain size. More practically, the term "grain formation" means the stage from the step of mixing and reacting a water-soluble silver salt and a water-soluble halide in the presence of a hydrophilic protective colloid to precipitate silver halide grains to the end of the physically ripening step performed in succession thereafter.

Therefore, the silver halide solvent of this invention may be added to the reaction system for forming silver halide grains in any desired form if it is added before completion of the foregoing physical ripening step. For example, the silver halide solvent of this invention may be added to an aqueous solution of a protective colloid in which silver halide is precipitated. Also, the silver halide solvent may be added in combination with a water-soluble silver salt (e.g., silver nitrate) or a water-soluble halide (e.g., an alkali metal halide such as potassium bromide, sodium chloride, etc.). It is also possible to add the silver halide solvent to the reaction system before or during physical ripening of the silver halide or add it during one of these steps or between two or more steps.

The amount of the silver halide solvent of this invention depends upon the kind of the silver halide solvent and the desired size of silver halide grains. Therefore, it is difficult to define decisively the amount which should be added. However, it is generally added in an amount in the range of $5\times10^{-4}$ mol to $5\times10^{-1}$ mol, preferably $1\times10^{-3}$ to $1\times10^{-1}$ mol per mol of silver halide.

The various conditions for the grain formation may be selected depending on the particular situation. The silver halide solvent of this invention possesses the effect of increasing the size of the silver halide grains even at a low pH. Therefore, the pH of the reaction solution at grain formation is not restricted. However, by controlling the pH to about 9 or less, in particular, in the range of about 5 to about 9, the grain size can be increased while preventing the occurrence of fog. The silver halide solvent of this invention causes the formation of regular silver halide grains (group) even at a high pAg range. Therefore, the value of pAg can be selected from a wide range. However, the pAg is preferably adjusted to 10 or less, in particular, about 7 to about 10. Also, it is preferred that the temperature at the grain formation is selected in the range of about 30° C. to about 90° C.

The pH value, pAg value, and temperature during grain formation may be changed during the aforesaid steps or may be maintained at constant values.

Examples of useful systems for reacting a water-soluble silver salt and a water-soluble halide include a one side mixing method, a simultaneous mixing method or a combination of both methods.

In this invention, a so-called reverse mixing method, i.e., a method of forming silver halide grains in the presence of excessive silver ion can be used.

One type of simultaneous mixing method which can be used in the controlled double jet method, i.e., a method of maintaining the pAg of the liquid phase, in which silver halide is formed, at a constant.

The step of precipitating silver halide grains or the step of physically ripening the silver halide grains may be performed in the presence of a cadmium salt, a zinc salt, a lead salt, a thallium salt, an iridium salt or a complex salt thereof, a rhodium salt or a complex salt thereof, or an iron salt or a complex salt thereof.

With respect to the foregoing steps it is possible to use known methods as described in, for example, P. Glafkides, *Chimie et Physique Photographique,* (published by Paul Montel Co., in 1967), F. G. Duffin, *Photographic Emulsion Chemistry,* (published by the Focal Press, in 1966), and V. L. Zelikman et al., *Making and Coating Photographic Emulsion,* (published by the Focal Press, in 1964).

The silver halide solvents of this invention can be used for forming silver halide grains having any desired compositions. More specifically, the solvent of the present invention can be used in the formation of grains of silver halides such as silver bromide, silver iodide, silver chloride, silver chlorobromide, silver bromoiodide and silver chlorobromoiodide. The silver halide solvent of this invention is particularly suitable for forming pure silver bromide or silver iodobromide containing less than about 10 mol% of silver iodide.

With respect to the grain size of the silver halide emulsion of this invention, the mean grain size is in a range of about 0.25 to 2 microns, preferably about 0.50 to 2 microns. Notwithstanding the conflicting relation between sensitivity and granularity, by using the silver halide solvent of this invention, silver halide emulsions having any grain sizes in the foregoing range can be produced. In addition, the diameter of a mean grain size of silver halide grains can be measured by the method described in, for example, *The Photographic Journal,* Vol. 79, pages 330–338 (1939).

The silver halide solvent of this invention is useful not only for the preparation of silver halide grains having a homogeneous phase throughout the grain but also in the preparation of silver halide grains (core/shell type grains) having a different phase from the inside and the surface layer of the grain. In particular, the silver halide solvent is useful for the preparation of the core portions of such core/shell type silver halide grains.

Internal latent image type direct positive silver halide emulsion composed of core/shell grains prepared using the silver halide solvent of this invention has an advantage of large discrimination (i.e., the difference between $D_{max}$ and $D_{min}$ is large).

Also, the silver halide solvent of this invention is useful for the preparation of silver halide grains for mainly forming latent images on the surface of the grains or the preparation of silver halide grains for mainly forming latent images in the inside of the grains.

The silver halide solvent of the present invention is particularly advantageous for preparing an internal latent image type core/shell emulsion.

The term "internal latent image type silver halide emulsion" is used herein to refer to an emulsion which, when coated on a support, exposed to light for a fixed time of from 0.01 to 1 second, and developed with Developer A (an internal type developer) as set forth hereinafter at 20° C. for 3 minutes, provides an image whose maximum density as determined by a conventional photographic density measuring method is at least five times that of an image which is obtained when the same emulsion as above is coated and exposed to light in the same manner as above, but is developed with Developer B (a surface type developer) as set forth hereinafter at 20° C. for 4 minutes.

| | Amount (g) |
|---|---|
| Developer A | |
| Hydroquinone | 15 |
| Monomethyl-p-aminophenolsesqui-sulfate | 15 |
| Sodium sulfite | 50 |
| Potassium bromide | 10 |
| Sodium hydroxide | 25 |
| Sodium thiosulfate | 20 |
| Water to make | 1 liter |
| Developer B | |
| p-Oxyphenylglycine | 10 |
| Sodium carbonate | 100 |
| Water to make | 1 liter |

Central core of silver halide prepared in the presence of the silver halide solvent of this invention is subjected to metal ion doping, chemical sensitization or a combination thereof and, thereafter, the surface of the central core of silver halide is covered with an outer shell of silver halide. The covering step with an outer shell of silver halide may be carried out in the presence of the silver halide solvent of this invention.

For metal ion doping of the central core, there can be employed a method, for example, in which the formation of silver halide grains in the central core or physical ripening thereof is performed in the presence of a metal ion source, e.g., cadmium salts, zinc salts, lead salts, thallium salts, iridium salts or complex salts thereof, rhodium salts or complex salts thereof, and iron salts or complex salts thereof. The amount of metal ions used is usually at least $10^{-6}$ mol per mol of silver halide.

The silver halide constituting the central core may be chemically sensitized with at least one noble metal sensitizer, sulfur sensitizer and/or a reduction sensitizer in place of the metal ion doping or alternatively in combination with the metal ion doping. In particular, gold sensitization and sulfur sensitization increase sensitivity.

Techniques to process the silver halide constituting the central core in the manner as described above and to cover the surface of silver halide grains with silver halide forming the outer shell are known in the art, and the methods described in, for example, U.S. Pat. Nos. 3,206,313, 3,317,322, 3,367,778 (excluding a step of fogging the surface of grains), and U.S. Pat. No. 3,761,276 are advantageously employed.

The ratio of silver halide of the central core to silver halide of the outer shell cannot be delimited uniformly.

Although the silver halide of the central core and the silver halide of the outer shell preferably have the same composition, they may have different compositions. Silver halides which can be used in the invention include silver bromide, silver iodide, silver chloride, silver chlorobromide, silver bromoiodide and silver chlorobromoiodide. Preferred silver halide emulsions are composed of at least 50 mol% of silver bromide. Of these emulsions, silver bromoiodide emulsions, particularly containing about 10 mol% or less of silver iodide, are most preferred.

The silver halide solvent may be used in accordance with these purposes, together with one or more known silver halide solvents (e.g., ammonia, potassium thiocyanate, the organic thioethers described in Japanese Patent Publication No. 11386/72 (which corresponds to U.S. Pat. No. 3,574,628), the organic thiones described in Japanese Patent Application (OPI) Nos. 144319/78 and 82408/78, and the imidazoles described in Japanese Patent Application (OPI) No. 100717/79 (which corresponds to U.S. Pat. No. 4,298,638)). When using the silver halide solvent of this invention in combination with a conventional solvent, the amount of the conventional silver halide solvent is restricted to an amount such that it does not cause the aforesaid faults.

Soluble salts are generally removed from the silver halide emulsion containing the silver halide grains thus formed, after the formation of the precipitates or after physical ripening. The soluble salts can be removed by performing a noodle washing method by gelling the gelatin or a precipitation method (flocculation) utilizing an inorganic salt composed of polyvalent anion, such as sodium sulfate; an anionic surface active agent; an anionic polymer (e.g., polystyrenesulfonic acid); or a gelatin derivative (e.g., aliphatic acylated gelatin, aromatic acylated gelatin, aromatic carbamoylated gelatin, etc.). Preferred precipitation methods are described in U.S. Pat. Nos. 2,614,928, 2,618,556, 2,565,418, 2,489,341, etc. The step of removing soluble salt may be omitted.

The silver halide emulsion of this invention may be used as a so-called primitive silver halide emulsion without applying chemical sensitization. However, chemical sensitization is generally used. Examples of useful chemical sensitization methods are described in P. Glafkides, *Chimie et Physique Photographique,* (published by Paul Montel); V. L. Zelikman et al., *Making and Coating Photographic Emulsion,* (published by The Focal Press, 1964); or H. Frieser, *Die Grundlagen der Photographischen Prozesse mit Silberhalogeniden,* (Akademische Verlagsgesellschaft, 1968).

That is, a sulfur sensitizing method using a sulfur-containing compound or active gelatin capable of reacting with silver ion, a reduction sensitizing method using a reducing material, and a noble metal sensitizing method using gold or other noble metal compound can be used solely or in combination thereof. Examples of useful sulfur sensitizers include thiosulfates, thioureas, thiazoles and rhodanines. Practical examples of sulfur sensitizers are described in, for example, U.S. Pat. Nos. 1,574,944, 2,410,689, 2,278,947, 2,728,668 and 3,656,955. Examples of useful reduction sensitizers include stannous salts, amines, hydrazine derivatives, formamidinesulfinic acid and silane compounds. Practical examples of reduction sensitizers are described in, for example, U.S. Pat. Nos. 2,487,850, 2,419,974, 2,518,698, 2,983,609, 2,983,610 and 2,694,637. For the noble metal sensitization, gold complex salts as well as complex salts of metals belonging to Group VIII of the Periodic Table, such as platinum, iridium, palladium, etc., can be used. Practical examples of noble metal sensitizers are described in, for example, U.S. Pat. Nos. 2,399,083 and 2,448,060 and British Pat. No. 618,061.

Also, the silver halide solvent of this invention may exist in the silver halide emulsion during chemical ripening.

The silver halide emulsion of this invention may be spectrally sensitized by methine dyes, etc. Examples of dyes used for this purpose include cyanine dyes, merocyanine dyes, composite cyanine dyes, composite merocyanine dyes, holopolar cyanine dyes, hemicyanine dyes, styryl dyes, and hemioxonol dyes. Particularly useful dyes are cyanine dyes, merocyanine dyes, and composite merocyanine dyes.

Practical examples of the useful sensitizing dyes are described in, for example, German Pat. No. 929,080, U.S. Pat. Nos. 2,231,658, 2,493,748, 2,503,776, 2,519,001, 2,912,329, 3,655,394, 3,656,959, 3,672,897 and 3,694,217, British Pat. No. 1,242,588 and Japanese Patent Publication No. 14030/69.

The silver halide emulsion prepared according to this invention can be fogged to provide a direct positive silver halide emulsion. Also, by doping a metal ion such as an iridium salt, a rhodium salt, or a lead salt to the silver halide grains, a direct positive silver halide emulsion having a high photographic sensitivity can be prepared. Furthermore, the silver halide grains of this invention can be applied to a direct positive silver halide emulsion of the type that a metal ion is not doped. Fogging can be attained by chemically or physically treating the silver halide in a conventional manner. In particular, by chemically fogging the silver halide emulsion (that is, by the addition of an inorganic reducing compound such as stannous chloride, boron hydride, etc., or by the addition of an organic reducing agent such as a hydrazine compound, formalin, thiourea dioxide, a polyamine compound, aminoboran, and methyldichlorosilane, etc.), a high reversal sensitivity is obtained.

In this invention, the silver halide grains may be fogged before coating them on a support or after coating.

In a case of the internal latent image core/shell emulsion, fogging with a nucleating agent during development is preferred. The nucleating agent may be added in the emulsion layer. Examples of the nucleating agents are described in U.S. Pat. Nos. 4,245,037, 4,255,511, 4,080,207, 4,115,122 and 4,030,925.

When the silver halide emulsions of this invention are used for direct positive photographic materials, the foregoing sensitizing dyes as well as so-called electron acceptors such as desensitizers or desensitizing dyes may be incorporated in the emulsions.

The silver halide photographic emulsions of this invention may further contain, for example, polyalkylene oxide or the ether, ester, amine, etc., thereof, thioether compounds, thiomorpholines, quaternary ammonium salts, urethane derivatives, urea derivatives, imidazole derivatives, 3-pyrazolidones, etc., for the purposes of increasing the sensitivity and contrast or accelerating the development. Practical examples of these compounds are described in, for example, U.S. Pat. Nos. 2,400,532, 2,423,549, 2,716,062, 3,617,280, 3,772,021 and 3,808,003.

Gelatin is preferably used as the binder or protective colloid for the silver halide photographic emulsion of this invention, but other hydrophilic colloids can be used. For example, it is possible to use gelatin derivatives, graft polymers of gelatin and other polymers; proteins such as albumin and casein; cellulose derivatives, such as hydroxyethyl cellulose, carboxymethyl cellulose and cellulose sulfuric acid ester; sugar derivatives such as sodium alginate and starch derivatives; and various synthetic hydrophilic polymers such as polyvinyl alcohol, polyvinyl alcohol partial acetal, poly-N-vinyl pyrrolidone, polyacrylic acid, polymethacrylic acid, polyacrylamide, polyvinyl imidazole and polyvinyl pyrazole.

Examples of useful gelatins include limed gelatin, acid-treated gelatin, or enzyme-treated gelatin as described in *Bull. Soc. Sci. Phot. Japan,* No. 16, page 30 (1966). It is also possible to use hydrolyzed products or enzyme-decomposition products of gelatin. Useful gelatin derivatives include the materials obtained by reacting gelatin and various compounds such as acid halide, acid anhydride, isocyanates, bromoacetic acid, alkane sultones, vinylsulfonamides, maleinimide compounds, polyalkylene oxides and epoxy compounds. Practical examples of these compounds are described in, for example, U.S. Pat. Nos. 2,614,928, 3,132,945, 3,186,846 and 3,312,553, British Pat. Nos. 861,414, 1,033,189 and 1,005,784, and Japanese Patent Publication No. 26845/67.

Useful gelatin graft polymers include the polymers obtained by grafting a homopolymer or copolymer of a vinylic monomer such as acrylic acid, methacrylic acid, the ester or amide thereof, acrylonitrile and styrene to gelatin. In particular, the graft polymers of gelatin and polymers having compatibility with gelatin to some extent, such as polymers of acrylic acid, methacrylic acid, acrylamide, methacrylamide and hydroxyalkyl methacrylate are preferred. Examples of these polymers are described in U.S. Pat. Nos. 2,763,625, 2,831,767 and 2,956,884.

Typical examples of the synthetic hydrophilic polymers are described in, for example, West German Patent Application (OLS) No. 2,312,708, U.S. Pat. Nos. 3,620,751 and 3,879,205, and Japanese Patent Publication No. 7561/68.

In the silver halide photographic emulsions of this invention, various compounds may be incorporated for preventing the occurrence of fog or stabilizing photographic properties during the production, preservation, or photographic processing of the photographic light-sensitive materials. That is, there are various compounds known as antifoggants or stabilizers, for example, azoles such as benzothiazolium salts, nitroindazoles, triazoles, benzotriazoles, benzimidazoles (in particular, nitro- or halogen-substituted products), etc.; heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines, etc.; the foregoing heterocyclic mercapto compounds having water-soluble groups such as carboxyl group and sulfone group; thioketo compounds such as oxazolinethione; azaindenes such as tetraazaindenes (in particular, 4-hydroxy-substituted (1,3,3a,7)tetraazaindenes), etc.; benzenethiosulfonic acids; benzenesulfinic acid; etc.

Practical examples and methods of using them are described in, for example, U.S. Pat. Nos. 3,954,474, 3,982,947 and 4,021,248 and Japanese Patent Publication No. 28660/77.

In the photographic light-sensitive materials of this invention, inorganic or organic hardening agents may be incorporated in the silver halide photographic emulsion layers and other hydrophilic colloid layers. For example, chromium salts (e.g., chrome alum, chromium acetate, etc.), aldehydes (e.g. formaldehyde, glyoxal, glutaraldehyde, etc.), N-methylol compounds (e.g., dimethylol urea, methylol dimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (mucochloric acid, mucophenoxychloric acid, etc.), etc., can be used solely or in combination.

The silver halide photographic emulsion layers and other hydrophilic colloid layers of the photographic materials of this invention may further contain various surface active agents for various purposes. For example, they may be used for a coating aid, static prevention, improvement of smoothness, emulsion-dispersion, adhesion prevention, and improvement of photographic properties (e.g., development acceleration, improvement of contrast, sensitization, etc.).

Examples of such compounds include nonionic surface active agents such as saponin (steroid series), alkylene oxide derivatives (e.g., polyethylene glycol, polyethylene glycol/polypropylene glycol condensation product, polyethylene glycol alkyl ethers, polyethylene glycol alkylaryl ethers, polyethylene glycol esters, polyethylene glycol sorbitan esters, polyalkylene glycol alkyl amines, polyalkylene glycol alkyl amides, siliconepolyethylene oxide addition products, etc.), glycidol derivatives (e.g., polyglyceride alkenylsuccinate, alkylphenol polyglyceride, etc.), fatty acid esters of polyhydric alcohols, alkyl esters of sugar, etc.; anionic surface active agents containing acid groups such as carboxy group, sulfo group, phospho group, sulfuric acid ester group, phosphoric acid ester group, etc., e.g., alkylcarboxilates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; amphoteric surface active agents such as aminoacids, aminoalkylsulfonic acids, aminoalkylsulfuric acids, aminoalkylphosphoric acid esters, alkylbetaines, amine oxides, etc.; and cationic surface active agents such as alkylamine salts, aliphatic or aromatic quaternary ammonium salts, heterocyclic quaternary ammonium salts (e.g., pyridinium, imidazolium, etc.), and phosphonium or sulfonium salts containing aliphatic or heterocyclic ring.

The photographic emulsion layers of the photographic materials of this invention may contain color-forming couplers, i.e., compounds capable of coloring by oxidative coupling with an aromatic primary amino developing agent (e.g., phenylenediamine derivatives, aminophenol derivatives, etc.) in color development. Examples of such couplers include magenta couplers such as a 5-pyrazolone coupler, a pyrazolobenzimidazole coupler, a cyanoacetylcumarone coupler, a closed chain acylacetonitrile coupler, etc.; yellow couplers such as an acylacetamide coupler (e.g., benzoylacetanilides, pivaloylacetanilides, etc.); and cyan couplers such as a naphthol coupler and a phenol coupler. The couplers are preferably non-diffusible couplers having a hydrophobic group called as ballast group in the molecule. The couplers may be of 4-equivalent or 2-equivalent for silver ion. Also, the couplers may be colored couplers having an effect of color correction, or couplers releasing development inhibitor with the progress of development (i.e., so-called DIR couplers). Also, colorless DIR coupling compounds which give colorless coupling reaction products and release development inhibitor may be used in place of the DIR couplers.

The silver halide photographic emulsions of this invention may further contain dye image-forming compounds (e.g., dye developers, dye-releasing redox compounds, DDR couplers, etc.) used for so-called diffusion transfer photography. Practical examples of these compounds are described in, for example, U.S. Pat. Nos. 4,053,312, 4,055,428, 4,076,529, 4,152,153 and 4,135,929, Japanese Patent Application (OPI) Nos. 149328/78, 104343/76, 46730/78, 130122/79, 3819/78, 12642/81, 16130/81 and 16131/81.

The silver halide emulsions of this invention may contain a developing agent. Useful developing agents are described in *Research Disclosure,* Vol. 176, page 29 (Developing agents).

The photographic materials of this invention may further contain dyes as filter dyes or for irradiation prevention or other various purposes in the silver halide emulsion layers and other hydrophilic colloid layers thereof. Such dyes are practically described in, for example, *Research Disclosure,* Vol. 176, pages 25–26 (Absorbing and filter dyes).

The silver halide photographic emulsions of this invention may further contain various additives such as antistatic agents, plasticizers, matting agents, lubricants, ultraviolet absorbents, optical whitening agents and anti-air-fogging agents.

The silver halide emulsions of this invention are coated on a support together with, if desired, other photographic layers. Coating methods described in *Research Disclosure,* Vol. 176, pages 27–28 (Coating procedures) can be used.

Useful supports include those described in *Research Disclosure,* Vol. 176, page 28 (Supports).

The silver halide photographic emulsions of this invention can be used for various uses. For example, the silver halide photographic emulsions can be used as color positive photographic emulsions, color paper photographic emulsions, color negative photographic emulsions, color reversal photographic emulsions (including a case of containing couplers and the case of not containing couplers), photographic emulsions for printing photographic materials (e.g., lithographic photographic films), photographic emulsions used for photographic materials for cathode ray tube display, photographic emulsions used for radiographic photographic materials (in particular, direct photographing radiographic photographic films using intensifying screens and indirect photographing photographic films), photographic emulsions used for colloid transfer processes (e.g., as described in U.S. Pat. No. 2,716,059), photographic emulsions used for silver salt diffusion transfer processes (described in, for example, U.S. Pat. Nos. 2,352,014, 2,543,181, 3,020,155, 2,861,885, etc.), photographic emulsions used for color diffusion transfer processes (described in, for example, U.S. Pat. Nos.

3,087,817, 3,185,567, 2,983,606, 3,253,915, 3,227,550, 3,227,551, 3,227,552, 3,415,644, 3,415,645, and 3,415,646, and *Research Disclosure,* Vol. 151, No. 15162, pages 75–87 (November 1976)), photographic emulsions used for imbibition transfer processes (described in, for example, U.S. Pat. No. 2,882,156), photographic emulsions used for silver dye bleaching processes (as described in, for example, Friedman, *History of Color Photography,* published by American Photographic Publishers Co., in 1944, particularly, Chapter 24, and *British Journal of Photography,* Vol. 111, pages 308–309, Apr. 7, 1964), photographic emulsions used for direct positive photographic materials (as described in, for example, U.S. Pat. Nos. 2,497,875, 2,588,982, 3,367,778, 3,501,306, 3,501,305, 3,672,900, 3,477,852, 2,717,833, 3,023,102, 3,050,395, 3,501,307, etc.), photographic emulsions used for heat-developing photographic materials (as described in, for example, U.S. Pat. Nos. 3,152,904, 3,312,550 and 3,148,122 and British Pat. No. 1,110,046) and photographic emulsions used for physical developing photographic materials (described in, for example, British Pat. Nos. 920,277, 1,131,238, etc.).

The silver halide photographic emulsions of this invention are particularly useful as photographic emulsions for multilayer color photographic materials of the type that the photographic emulsion layers thereof contain couplers. In particular, they are used as photographic emulsions for multilayer reversal color photographic materials and negative color photographic materials, photographic emulsions for black-and-white negative photographic materials (e.g., black-and-white high speed negative photographic films, micro negative photographic films, etc.), photographic emulsions for color diffusion transfer process, and photographic emulsions for direct positive photographic materials.

Light exposure for obtaining photographic images using the photographic light-sensitive materials prepared using the silver halide emulsions of this invention may be performed in a conventional manner. That is, various known light sources such as natural light (sunlight), tungsten lamp, fluorescent lamp, mercury lamp, xenon arc lamp, carbon arc lamp, xenon flash lamp, cathode ray flying spot, etc. can be used. The exposure time is not only from 1/1,000 sec. to 1 sec. used in ordinary in-camera exposure but also shorter than 1/1,000 sec., e.g., $1/10^4$ to $1/10^6$ sec. as in the case of using xenon flash lamp or cathode ray tube or longer than 1 sec. If desired, the spectral composition of light used for the exposure can be controlled by a color filter. Furthermore, laser light can be employed for the exposure. Also, the photographic materials may be exposed by the light emitted from phosphor excited by electron beams, X-rays, gamma rays, $\alpha$-rays, etc.

The photographic materials of this invention can be processed by known processes. Known processing materials can be used. The processing temperature is usually selected from the range of 18° C. to 50° C. but may be lower than 18° C. or over 50° C. Depending on the particular purpose, development for forming silver images (black-and-white development) or color photographic processes composed of a development process forming dye images may be applied.

The developer used for black-and-white development may contain a known developing agent. Useful developing agents include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and the heterocyclic compounds formed by the condensation of 1,2,3,4-tetrahydroquinoline ring and indolene ring as described in U.S. Pat. No. 4,067,872. They can be used solely or in combination. The developer may contain preservatives, alkalifying agents, pH buffers, antifoggants, etc., and further, may contain, if desired, dissolution aids, toning agents, development accelerators, surface active agents, defoaming agents, water softeners, hardening agents, tackifiers, etc.

To the photographic emulsions of this invention may be applied a so-called "lithographic type" development process. The "lithographic type" development process is a development process of infectiously performing the development step under a low sulfite ion concentration generally using a dihydroxybenzene as the developing agent for photographically reproducing line images or photographically reproducing half tone images as dot images (details are described in, for example, Mason, *Photographic Processing Chemistry,* pages 163–165 (1966)).

In accordance with a specific development system, a developing agent is incorporated in the photographic material, e.g., a silver halide emulsion layer thereof. The development of the photographic material may be performed by processing the photographic material in an aqueous alkali solution. In the developing agents, a hydrophobic developing agent can be incorporated in the silver halide emulsion layer as a latex dispersion as disclosed in *Research Disclosure,* Vol. 169, RD-16928. Such a development process may be performed in combination with a silver salt stabilization process with a thiocyanate.

A fixing solution having an ordinary composition may be used for fixing the photographic material of this invention. Useful fixing agents include a thiosulfate, a thiocyanate, as well as an organic sulfur compound having an effect as a fixing agent. The fix solution may contain a water-soluble aluminum salt as a hardening agent.

Conventional process can be applied to form dye images. Specific examples include a nega-posi process (as described in, for example, *Journal of the Society of Motion Picture and Television Engineers, Vol.* 61, pages 667–701 (1953)); a color reversal process of obtaining positive dye images by developing the photographic material with a developer containing a black-and-white developing agent to form negative silver images, performing at least one overall exposure or proper fogging treatment, and then performing a color development; and a silver dye bleaching process of developing photographic emulsion layers containing dyes after light exposure to form silver images and bleaching the dyes using the silver images as a bleaching catalyst.

A color developer is generally composed of an aqueous alkaline solution containing a color developing agent. Useful color developing agent include known aromatic primary amine developing agents such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline and 4-amino-3-methyl-N-ethyl-N-$\beta$-methoxyethylaniline).

Furthermore, other color developing agents described in L.F.A. Mason, *Photographic Processing Chemistry,* pages 226–229 (published by Focal Press, in 1966) and U.S. Pat. Nos. 2,193,015 and 2,592,363 and Japanese Patent Application (OPI) No. 64933/73 can be used.

The color developer may further contain a pH buffer such as a sulfite, carbonate, borate, and phosphate of an alkali metal and a development inhibitor or an antifoggant such as a bromide, an iodide, and organic antifoggants. If desired, the color developer may contain a water softener; a preservative such as hydroxylamine; an organic solvent such as benzyl alcohol, diethylene glycol, etc.; a development accelerator such as polyethylene glycol, a quaternary ammonium salt, an amine, etc.; dye forming couplers; competing couplers; a fogging agent such as sodium borohydride, etc.; an auxiliary developing agent such as 1-phenyl-3-pyrazolidone, etc.; a tackifier; the polycarboxylic acid series chelating agents as described in U.S. Pat. No. 4,083,723; and the antioxidants as described in West German Patent Application (OLS) No. 2,622,950.

The photographic silver halide emulsion layers after color development are usually bleached. The bleaching process may be performed simultaneously with a fixing process or may be performed separately from the latter process. Useful bleaching agents include compounds of polyvalent metals such as iron (III), cobalt (III), chromium (VI), copper (II), etc., peracids, quinones, and nitroso compounds. For example, there are ferricyanide; dichromates; organic complex salts of iron (III) or cobalt (III); aminopolycarboxylic acids such as ethylenediaminetetraacetic acid, nitrilotriacetic acid, 1,3-diamino-2-propanoltriacetic acid, etc.; complex salts of organic acids such as citric acid, tartaric acid, malic acid, etc.; persulfates; permanganates; nitrosophenol, etc. In the foregoing compounds, potassium ferricyanide, sodium iron (III) ethylenediaminetetraacetic acid, and ammonium iron (III) ethylenediaminetetraacetic acid are particularly useful. Also, an ethylenediaminetetraacetic acid iron (III) complex salt is useful in a bleach solution or in a blix solution.

The bleach solution or blix solution may further contain various additives such as the bleach accelerating agents as described in U.S. Pat. Nos. 3,042,520 and 3,241,966, and Japanese Patent Publication Nos. 8506/70 and 8836/70, the thiol compounds described in Japanese Patent Application (OPI) No. 65732/78, etc.

When the invention is applied to a diffusion transfer process, a tacky developer can be used.

The tacky developer is a liquid developer containing processing components necessary for developing silver halide photographic emulsions and forming diffusion transfer dye images. The solvent is mainly composed of water and may contain, as the case may be, a hydrophilic solvent such as methanol, methyl cellosolve, etc. The processing composition contains an alkali in an amount sufficient for maintaining the necessary pH for causing development of silver halide emulsions and also neutralizing acids (e.g., a hydrohalogenic acid such as hydrobromic acid, etc., or a carboxylic acid such as acetic acid, etc.) formed during the various steps for development and dye image formation. Useful alkalis include alkali metal or alkaline earth metal salts or amines, such as lithium hydroxide, sodium hydroxide, potassium hydroxide, calcium hydroxide dispersion, tetramethylammonium hydroxide, sodium carbonate, sodium tertiary phosphate and diethylamine. The processing composition preferably contains the alkali at a concentration giving a pH above about 11, in particular, above 13 at room temperature. More preferably, the processing composition contains a hydrophilic polymer such as high molecular weight polyvinyl alcohol, hydroxyethyl cellulose, sodium carboxymethyl cellulose, etc. It is preferred to use the polymer in such a manner that the processing composition has a viscosity above 1 poise, preferably about 500 to 1,000 poises at room temperature.

It is particularly advantageous with respect to a monosheet film unit that the processing composition further contains a light absorbing material such as $TiO_2$, carbon black, a pH indicating dye, etc., for preventing the silver halide emulsion layers from being fogged by external light during or after processing and the desensitizer as described in U.S. Pat. No. 3,579,333. Moreover, the processing composition may further contain a development inhibitor such as benzotriazole.

It is preferred the foregoing processing composition be used in the rupturable container as described in, for example, U.S. Pat. Nos. 2,543,181, 2,643,886, 2,653,732, 2,723,051, 3,056,491, 3,056,492, 3,152,515, etc.

When the silver halide emulsions of this invention are used for a diffusion transfer photographic process, it is preferred that the photographic material is in the form of film unit. A photographic film unit which is developed by passing through a pair of jaxtaposed pressing means is fundamentally composed of the following three elements:

(1) a light-sensitive element containing the silver halide photographic emulsions of this invention and a fogging agent, (2) an image-receiving layer, and (3) a processing element: having a means such as a rupturable container for releasing an alkaline processing composition in the film unit and containing a silver halide developing agent.

A preferred embodiment of the photographic film unit is a unitary type of element as disclosed in Belgian Pat. No. 757,959. According to this embodiment, an image-receiving layer, a substantially opaque light-reflective layer (for example, a $TiO_2$ layer and a carbon black layer), and a light-sensitive layer composed of single or plural silver halide photosensitive emulsion layers having associated therewith DRR compounds are coated on a transparent support in this order, and further a transparent cover sheet is superposed on the layer in face-to-face relation. A rupturable container containing an alkaline processing composition containing an opacifying agent (e.g., carbon black) is disposed adjacent to the foregoing the uppermost layer of the light-sensitive layers and the transparent cover sheet. Such a film unit is exposed through the transparent cover sheet, the container is ruptured by a pressing means while pulling the film unit out of the camera. Accordingly, the processing composition (containing the opacifying agent) is spread over between the protective layer on the light-sensitive layer and the cover layer. Thereby the film unit is shaded and the development proceeds. It is preferred that a neutralizing layer and further, if desired, a neutralization speed controlling layer (timing layer) are formed on the support in this order.

Other useful laminated unitary embodiments capable of using DRR compounds or diffusible dye releasing couplers are described in, for example, U.S. Pat. Nos. 3,415,644, 3,415,645, 3,415,646, 3,647,487 and 3,635,707 and West German Patent Application (OLS) No. 2,426,980.

The following examples will further illustrate the present invention.

EXAMPLE 1

A silver halide photographic emulsion (Emulsion A) was prepared by simultaneously adding an aqueous solution of potassium bromide and an aqueous solution of silver nitrate to an aqueous solution of gelatin under vigorous stirring at 60° C. over a period of about 60 minutes. During the precipitation step, the pH was maintained at 6.5 and pAg was maintained at 9.3. The Emulsion A was a mono-dispersed silver bromide emulsion having a grain size of 0.2 micron. The emulsion was washed with water according to an ordinary manner.

By following the same manner as in the case of preparing Emulsion A except that Compound (1), (2) or (3) which is the silver halide solvent of this invention was added to the aqueous gelatin solution before the precipitation of silver halide at $2.4\times10^{-2}$ mol per mol of silver nitrate, Emulsions B, C and D were prepared. These photographic emulsions were octahedral mono-dispersed silver bromide emulsions having the mean grain sizes as shown in Table 1.

Each of the photographic emulsions thus prepared was sulfur- and gold-sensitized as described in U.S. Pat. No. 2,399,083. Each sample of the silver halide emulsions was coated on a cellulose acetate film support at a silver coverage of 400 mg/ft$^2$ and a gelatin coverage of 656 mg/ft$^2$. Each coated sample was exposed by tungsten light of 400 lux through an optical wedge for 1/10 sec and then developed by a surface developer X having the composition shown below at 20° C. for 10 minutes.

| Composition of the Surface Developer X: | |
|---|---|
| N—Methyl-p-aminophenol sulfate | 2.5 g |
| Ascorbic acid | 10.0 g |
| Potassium metaborate | 35.0 g |
| Potassium bromide | 1.0 g |
| Water to make | 1 liter |

About each sample, the photographic sensitivity at a definite density (optical density of 0.1) higher than fog density was measured by a same manner. These results are shown in Table 1.

TABLE 1

| Emulsion No. | Silver Halide Solvent | Mean Grain Size | Relative Sensitivity | Remarks |
|---|---|---|---|---|
| A | None | 0.20μ | 100 | Comparison |
| B | Compound (1) | 0.40μ | 684 | Invention |
| C | Compound (2) | 0.37μ | 570 | " |
| D | Compound (3) | 0.42μ | 692 | " |

As shown in the above Table, it is understood that the photographic emulsions prepared by precipitating in the presence of the silver halide solvents of this invention have large mean grain size and show very high speed.

When the same procedure as above was followed using an aqueous solution of potassium bromide and potassium iodide in place of the aqueous solution of potassium bromide, similar results were obtained. That is, the photographic emulsions prepared by precipitating in the presence of the silver halide solvents of this invention have a mean grain size about 2 times as large as that prepared by precipitating in the absence of the silver halide solvent. Furthermore, the photographic emulsions prepared by precipitating in the presence of the silver halide solvents of this invention have a speed about 7 times as high as that prepared by precipitating in the absence of the silver halide solvent.

EXAMPLE 2

A photographic silver halide emulsion (Emulsion E) was prepared by simultaneously adding an aqueous soluiton of potassium bromide and an aqueous solution of silver nitrate to an aqueous gelatin solution under vigorous stirring at 60° C. over a period of about 60 minutes. During the precipitation step, the pH and pAg were maintained at 6.5 and 9.9, respectively. The photographic emulsion (Emulsion E) was a silver bromide photographic emulsion composed of polydispersed plate twin grains having a mean grain size of about 1.5 microns.

By following the same procedure as in the case of preparing Emulsion E except that imidazole which is the silver halide solvent described in Japanese Patent Application (OPI) No. 100717/79 (which corresponds to U.S. Pat. No. 4,298,638) was added to the aqueous gelatin solution at $2.4\times10^{-2}$ mol per mol of silver nitrate before the precipitation of silver halide, a silver halide photographic emulsion (Emulsion F) was prepared. Emulsion F was a silver bromide photographic emulsion composed of poly-dispersed plate twin grains having a mean grain size of about 2.0 microns.

Also, by following the same procedure as in Emulsion E except that benzimidazole, Compound (1) which is the silver halide solvent of this invention, was added to the aqueous gelatin solution at $2.4\times10^{-2}$ mol per mol of silver nitrate before the precipitation of silver halide, a silver halide photographic emulsion (Emulsion G) was prepared. Emulsion G was a mono-dispersed silver bromide emulsion composed of regular octahedral grains having a mean grain size of 0.6 micron.

About Emulsions E, F and G, the dispersion coefficient of the grain size distribution was measured using the method described in T. H. James, *The Theory of the Photographic Process*, 4th Edition, pages 100–101, published by Macmillan Publishing Co. and the results are shown in Table 2. Also, each of the photographic emulsions was coated by the same way as in Example 1 and after exposure, the gamma was measured. The results are also shown in Table 2.

TABLE 2

| Emulsion No. | Form | Dispersion Coefficient (%) | Gamma | Remarks |
|---|---|---|---|---|
| E | Plate form | 30 | 0.5 | Comparison |
| F | Plate form | 30 | 0.5 | " |
| G | Octahedron | 8 | 2.5 | Invention |

From the above results, it is understood that the silver halide emulsion prepared by precipitating in the presence of the silver halide solvent of this invention is a mono-dispersed silver halide emulsion and has large gamma.

EXAMPLE 3

By Methods a to f described below, mono-dispersed silver bromide emulsions (Emulsions H to M) each composed of octahedral grains having a mean grain size of about 0.8 micron were prepared.

Method a (Comparison)

Emulsion H was prepared by simultaneously adding an aqueous solution of 0.15 mol of silver nitrate and an aqueous solution of potassium bromide to an aqueous gelatin solution containing 3,4-dimethyl-1,3-thiazolidine-2-thione as a silver halide solvent at $2.4\times10^{-4}$ mol per mol of silver nitrate under vigorously stirring at 75° C. over a period of 60 minutes and further simultaneously adding an aqueous solution of 0.85 mol of silver nitrate and an aqueous solution of potassium bromide to the mixture while vigorously stirring at 75° C. over a period of 80 minutes. During the precipitation step, the pH and pAg were maintained at 6.5 and 9.6, respectively.

Method b (Comparison)

By following the same procedure as in Method a except that N,N,N',N'-tetramethylthiourea was added to the gelatin solution in place of 3,4-dimethyl-1,3-thiazolidine-2-thione at $4.4\times10^{-4}$ mol per mol of silver nitrate before the precipitation of the silver halide, Emulsion I was prepared.

Method c (Comparison)

By following the same procedure as in Method a except that 1,8-dihydroxy-3,6-dithiaoctane was added to the aqueous gelatin solution in place of 3,4-dimethyl-1,3-thiazolidine-2-thione at $6.8\times10^{-3}$ mol per mol of silver nitrate before the precipitation of the silver halide, Emulsion J was prepared.

Method d (This Invention)

By following the same procedure as in Method a except that Compound (1) which is the silver halide solvent of this invention was added to the aqueous gelatin solution in place of 3,4-dimethyl-1,3-thiazolidine-2-thione at $3.4\times10^{-2}$ mol per mol of silver nitrate before the precipitation of the silver halide, Emulsion K was prepared.

Method e (This Invention)

By following the same procedure as in Method a except that Compound (1) at $1.7\times10^{-2}$ mol per mol of silver nitrate and 3,4-dimethyl-1,3-thiazolidine-2-thione at $1.2\times10^{-4}$ mol per mol of silver nitrate were added to the aqueous gelatin solution in place of $2.4\times10^{-4}$ of 3,4-dimethyl-1,3-thiazolidine-2-thione before the precipitation of the silver halide, Emulsion L was prepared.

Method f (This Invention)

By following the same procedure as in Method a except that Compound (1) at $1.7\times10^{-2}$ mol per mol of silver nitrate and 1,8-dihydroxy-3,6-dithiaoctane at $3.4\times10^{-3}$ mol per mol of silver nitrate were added to the aqueous gelatin solution in place of $2.4\times10^{-4}$ of 3,4-dimethyl-1,3-thiazolidine-2-thione before the precipitation of the silver halide, Emulsion M was prepared.

Each of the photographic emulsions H to M thus prepared was adjusted to pH 4.4 using the condensation product of sodium naphthalenesulfonate and formalin according to the description of Japanese Patent Publication No. 16086/60, washed with water (desalting) by a flocculation method, and then subjected to post ripening (chemical sensitization) at 60° C. and at a pAg of 8.0 with the addition of $5\times10^{-6}$ mol of sodium thiosulfate, $3\times10^{-6}$ mol of chloroauric acid, and $4\times10^{-4}$ mol of potassium thiocyanide per mol of silver bromide.

Each emulsion sample (containing no sensitizing dye) before the post ripening, after 30 minutes since the start of the post ripening, or after 60 minutes since the start of the post ripening or an emulsion sample prepared by adding the red-sensitive sensitizing dye shown below to each emulsion sample after 60 minutes since the start of the post ripening at $7.6\times10^{-6}$ mol per mol of silver bromide was coated on a cellulose acetate film support at a silver coverage of 400 mg/ft$^2$ and a gelatin coverage of 656 mg/ft$^2$. Each of the coated samples was exposed by tungsten light of 400 lux through an optical wedge for 1/10 sec, and then developed for 10 minutes at 20° C. with the surface developer X as used in Example 1. About each sample, the photographic sensitivity at a definite density (optical density of 0.1) higher than fog density and the fog density were measured in the same manner. The results are shown in Table 3.

Red-Sensitive Sensitizing Dye

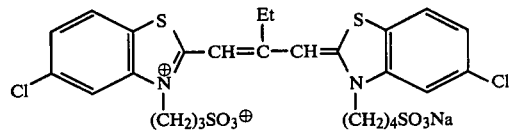

TABLE 3

| Emulsion | Fog*1 | Relative Sensitivity: Before Ripening | After 30 Min | After 60 Min | ΔSens*2 | Remarks |
|---|---|---|---|---|---|---|
| H | 0.03 | 100 | 740 | 1,100 | 260 | Comparison |
| I | 0.035 | 100 | 710 | 1,040 | 210 | " |
| J | 0.09 | 100 | 990 | 1,710 | 120 | " |
| K | 0.03 | 100 | 960 | 1,620 | 310 | Invention |
| L | 0.03 | 100 | 810 | 1,370 | 290 | " |
| M | 0.05 | 100 | 870 | 1,660 | 270 | " |

*1After 60 minutes from the start of the ripening.
*2Increased sensitivity by the addition of the sensitizing dye at $7.6\times10^{-6}$ mol per mol of silver halide.

The silver halide emulsions (Emulsions H and I) prepared by performing the grain formation in the presence of 3,4-dimethyl-1,3-thiazolidine-2-thione or N,N,N',N'-tetramethylthiourea which are an organic thione series silver halide solvent showed less increase in sensitivity by post ripening and also showed less increase in sensitivity by the addition of the sensitizing dye. This is considered to be caused by the fact that the organic thione series silver halide solvent remains in the emulsion during the ripening reaction without being removed by washing to restrict the sensitizing reaction.

The silver halide emulsion (Emulsion J) prepared by performing the grain formation in the presence of 1,8-dihydroxy-3,6-dithiaoctane which is an organic thioether series silver halide solvent showed increased sensitivity by post ripening but also showed very increased formation of fog. This is considered to be caused by the fact that the organic thioether series silver halide solvent remains in the emulsion without being desorbed by washing and the solvent itself sensitizes the emulsion and at the same time increases the formation of fog.

On the other hand, the silver halide emulsion (Emulsion K) prepared by precipitating using benzimidazole which is the silver halide solvent of this invention shown by general formula (I) showed high sensitivity and less formation of fog as compared to Emulsions H and I. Furthermore, the increase in sensitivity by the addition of the sensitizing dye is large. This is considered to be caused by the fact that the silver halide solvent of this invention is almost completely desorbed by washing and hence it does not obstruct the post ripening reaction and the adsorption of the sensitizing dye applied thereafter.

In the silver halide emulsions (Emulsions L and M) prepared by using the silver halide solvent of tihs invention together with the known silver halide solvent, the amount of the known silver halide solvent can be kept low, thereby the faults of increasing the formation of fog and obstructing post ripening reaction and adsorption of a sensitizing dye occurring in the case of using the known silver halide solvent solely can be substantially eliminated.

EXAMPLE 4

Each mono-dispersed silver bromide emulsion as prepared in Example 3 (Emulsions H to M) was chemically sensitized by adding 2.5 mg/mol Ag of sodium thiosulfate and 1.2 mg/mol Ag of potassium chloroaurate followed by heating at 75° C. for 80 minutes. Thus, core silver bromide emulsions were prepared.

Each core emulsion (1 mol) was further subjected to the same silver halide precipitation step for forming Emulsions H to M, respectively (i.e., Methods a to f, respectively) over a period of 40 minutes. Thus, core/-shell type emulsions each having a mean grain size of 1.2μ were obtained.

Each core/shell type emulsion was chemically sensitized by adding 1.2 mol/mol Ag of sodium thiosulfate followed by heating at 60° C. for 60 minutes. Thus, core/shell type direct positive emulsions (Emulsions N to S) were prepared.

To each Emulsions N to S was added 6.8 mg/mol Ag of the fogging agent shown below.

Fogging Agent

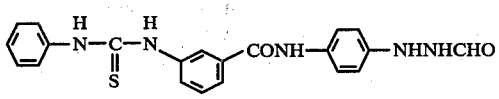

Each resulting emulsion was coated on a cellulose acetate film support at a silver coverage of 400 mg/ft$^2$ and a gelatin coverage of 656 mg/ft$^2$. Each of the coated samples was exposed by tungsten light of 400 lux through an optical wedge for 1/10 sec, and then developed with the developer X' having the following composition.

| Composition of the Developer X': | |
|---|---|
| Sodium sulfite | 30 g |
| Hydroquinone | 10 g |
| 1-Phenyl-4-methyl-4-hydroxymethyl-3-pyrazolidinone | 0.75 g |
| Sodium phosphate | 40 g |
| Sodium hydroxide | 10.7 g |
| 5-Methylbenzotriazole | 0.02 g |
| Water to make | 1 liter |

About each sample, maximum density ($D_{max}$) and minimum density ($D_{min}$) of the resulting image were measured. The results are shown in Table 4.

TABLE 4

| Core Emulsion | Core/Shell Type Direct Positive Emulsion | $D_{max}$ | $D_{min}$ | Remarks |
|---|---|---|---|---|
| H | N | 1.07 | 0.09 | Comparison |

TABLE 4-continued

| Core Emulsion | Core/Shell Type Direct Positive Emulsion | $D_{max}$ | $D_{min}$ | Remarks |
|---|---|---|---|---|
| I | O | 1.03 | 0.09 | " |
| J | P | 1.20 | 0.13 | " |
| K | Q | 1.42 | 0.09 | Invention |
| L | R | 1.27 | 0.09 | " |
| M | S | 1.38 | 0.11 | " |

It is apparent from Table 4 that Emulsion Q prepared by precipitating using benzimidazole which is the silver halide solvent of this invention shown by the general formula (I) provided higher $D_{max}$ as compared with that of Emulsions N and O and lower $D_{min}$ as compared with that of Emulsion P.

When the silver halide solvent of this invention was used together with the conventional silver halide solvent (i.e., Emulsions R and S), the faults of decreasing $D_{max}$ and increasing $D_{min}$ occurring in the case of using conventional silver halide solvent solely can be substantially eliminated.

While the invention has been described in detail and with reference to specific embodiments thereof, it will be apparent to one skilled in the art that various changes and modifications can be made therein without departing from the spirit and scope thereof.

What is claimed is:

1. A silver halide emulsion, comprising:

a binder; and regular silver halide grains having a cubic, octahedral or tetradecahedral crystal habit dispersed in the binder, said silver halide being pure silver bromide or silver iodobromide containing less than about 10 mol% of silver iodide and the grains having been formed in the presence of a benzimidazole derivative compound by grain formation and water washed after the grain formation, said imidazole derivative being represented by the general formula (I):

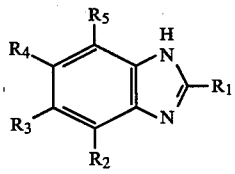

(I)

wherein $R_1$ represents a hydrogen atom, a halogen atom, an alkyl group which may be substituted by a hydroxy group, a cyano group, an alkoxy group, an unsubstituted, mono-substituted or disubstituted amino group, a morpholino group, a free or esterified carboxyl group, a free or esterified sulfo group, or an aryl group, an alkenyl group, an aryl group, or a heterocyclic residue and $R_2$ to $R_5$, which may be the same or different, each represents a hydrogen atom, a halogen atom, a hydroxy group, an amino group, a nitro group, a cyano group, a carboxy group or a salt thereof, a sulfo group or a salt thereof, an alkyl group, an alkenyl group, an aryl group, or a group shown by $R_6$—D— wherein $R_6$ represents a hydrogen atom, an alkyl group or an aryl group and D represents —$SO_2$—, —COO—, —OCO—, —CONH—, —NHCO—, $SO_2NH$— or —$NHSO_2$—.

2. A silver halide emulsion as claimed in claim 1 wherein the alkyl group for $R_1$ contains 1 to 8 carbon atoms.

3. A silver halide emulsion as claimed in claim 1, wherein the aryl group for $R_1$ contains 6 to 12 carbon atoms.

4. A silver halide emulsion as claimed in claim 1, wherein the alkenyl group for $R_1$ contains 3 to 8 carbon atoms.

5. A silver halide emulsion as claimed in claim 1, wherein the heterocyclic residue for $R_1$ is a 5- or 6-membered ring containing a nitrogen atom or an oxygen atom.

6. A silver halide emulsion as claimed in claim 1, wherein $R_6$ is an alkyl group having 1 to 4 carbon atoms or an aryl group having 6 to 12 carbon atoms.

7. A silver halide emulsion as claimed in claim 1, wherein $R_1$ is a hydrogen atom or a lower alkyl group having 1 to 4 carbon atoms and $R_2$ to $R_5$ are hydrogen atoms.

8. A silver halide emulsion as claimed in claim 1, wherein the silver halide grains are formed by adding the benzimidazole derivative of the general formula (I) in an amount of $5\times10^{-4}$ mol to $5\times10^{-1}$ mol per mol of silver halide.

9. A silver halide emulsion as claimed in claim 8, wherein the benzimidazole derivative of the general formula (I) is present in an amount of $1\times10^{-3}$ to $1\times10^{-1}$ mol per mol of silver halide.

10. A silver halide emulsion as claimed in claim 1, wherein the silver halide grains have a mean grain size in the range of about 0.25 to 2 microns.

11. A silver halide emulsion as claimed in claim 10, wherein the silver halide grains have a mean grain size of about 0.50 to 2 microns.

12. A silver halide emulsion as claimed in claim 1, wherein the silver halide emulsion is an internal latent type core/shell emulsion containing core silver halide grains formed in the presence of the benzimidazole derivative of the general formula (I).

13. A silver halide light-sensitive photographic material, comprising:

a support base; and a silver halide emulsion positioned on a surface of the base, wherein the emulsion is comprised of a binder having dispersed therein regular silver halide grains having a cubic, octahedral or tetradecahedral crystal habit, said silver halide being pure silver bromide or silver iodobromide containing less than about 10 mol% of silver iodide and, the grains have been formed in the presence of a benzimidazole derivative compound by grain formation and water washed after the grain formation, said imidazole derivative being represented by the general formula (I):

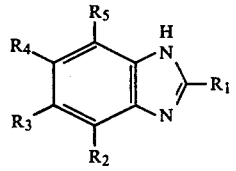

(I)

wherein $R_1$ represents a hydrogen atom, a halogen atom, an alkyl group which may be substituted by a hydroxy group, a cyano group, an alkoxy group, an unsubstituted, mono-substituted or disubstituted amino group, a morpholino group, a free or esterified carboxyl group, a free or esterified sulfo group, or an aryl group, an alkenyl group, an aryl group, or a heterocyclic residue and $R_2$ to $R_5$, which may be the same or different, each represents a hydrogen atom, a halogen atom, a hydroxy group, an amino group, a nitro group, a cyano group, a carboxy group or a salt thereof, a sulfo group or a salt thereof, an alkyl group, an alkenyl group, an aryl group, or a group shown by $R_6$—D— wherein $R_6$ represents a hydrogen atom, an alkyl group or an aryl group and D represents —$SO_2$—, —COO—, —OCO—, —CONH—, —NHCO—, —$SO_2$NH— or —$NHSO_2$—.

* * * * *